United States Patent [19]

Gregson

[11] 4,241,496

[45] Dec. 30, 1980

[54] BLADE STORAGE AND SELECTABLE FORCE IMPACT TERMINATION TOOL

[75] Inventor: Donald L. Gregson, Paradise, Calif.

[73] Assignee: Dracon Industries, Chatsworth, Calif.

[21] Appl. No.: 23,189

[22] Filed: Mar. 23, 1979

Related U.S. Application Data

[63] Continuation of Ser. No. 825,671, Aug. 18, 1977, abandoned.

[51] Int. Cl.[3] ..... H01R 43/04

[52] U.S. Cl. ..... 29/751; 7/107; 29/566.4; 29/758; 30/339; 173/120

[58] Field of Search ..... 29/751, 750, 758, 566.4; 173/120; 7/107; 145/61 J, 50 C; 30/337, 339, 342

[56] References Cited

U.S. PATENT DOCUMENTS

| | | | |
|---|---|---|---|
| 2,776,484 | 1/1957 | Resner | 30/337 X |
| 3,845,554 | 11/1974 | Joanis et al. | 30/339 X |
| 3,863,339 | 2/1975 | Reaney et al. | 30/339 X |
| 3,883,316 | 5/1975 | Mason | 29/566.4 |
| 3,896,534 | 7/1975 | Kaufman et al. | 29/566.4 |
| 3,898,724 | 8/1975 | Conorich | 29/566.4 |
| 4,161,061 | 7/1979 | Mason et al. | 29/566.4 |

FOREIGN PATENT DOCUMENTS

| | | | |
|---|---|---|---|
| 2365117 | 10/1975 | Fed. Rep. of Germany | 173/120 |

*Primary Examiner*—Carl E. Hall
*Attorney, Agent, or Firm*—Flehr, Hohbach, Test

[57] ABSTRACT

A hand held termination tool which is used in conjunction with a termination blade for connecting conductor wires to terminals on a termination block has a handle within which is disposed a hammer assembly. A slide assembly is mounted in the handle yieldably urged to a position extending from one end thereof and disposed to receive an impact blow from the hammer assembly when forced inwardly from the extended position a predetermined distance. The hammer assembly includes a drive spring providing the force for the impact. A drive spring seat member supports one end of the drive spring and is movable between an extended and a retracted position, thereby providing a short compressed drive spring length in the extended position and a longer compressed drive spring length in the retracted position. A cam adjustable to either one of two positions selects either the short or longer compressed lengths for the drive spring and thereby a high or a low impact force respectively. A pouch assembly is provided in the end of the handle opposite that through which the slide assembly extends, being in communication with an opening in the handle. Both the slide assembly and pouch assembly are configured to accept and retain a termination tool blade, so that one blade may be inserted into the slide assembly for terminating conductors while the other blade is stored in the pouch assembly for future use as desired.

3 Claims, 7 Drawing Figures

BLADE STORAGE AND SELECTABLE FORCE IMPACT TERMINATION TOOL

This is a continuation of application Ser. No. 825,671 filed Aug. 18, 1977, now abandoned.

BACKGROUND OF THE DISCLOSURE

This invention relates to a termination tool, and more particularly to such a tool for use with terminal blocks carrying different terminal configurations requiring different impact forces for conductor termination.

There are at least two predominant terminal types utilized in terminal arrays in telephone equipment terminal installations presently in use. One of the terminals is called an "88" type terminal, and the other is called a "66" type terminal (Western Electric Company designations). The "88" terminal accepts a smaller conductor wire than the "66" type terminal and therefore requires a lower impact force to be delivered for seating the conducting wire in the terminal. As a consequence, a worker terminating conductors in an installation containing both types of terminal blocks had to carry two separate termination tools in the past, one having a factory adjusted low impact force, and the other having a factory adjusted high impact force for use with the "88" and "66" type terminals respectively. A typical termination tool is disclosed in U.S. Pat. No. 3,708,852 having an impact assembly in a handle and a slide assembly subject to an impact extending from one end of the handle. The worker must also carry the appropriate termination tool blade for each terminal type. A termination tool blade for use with the type "66" terminal is disclosed in U.S. Pat. No. 3,883,316, and a blade for use with the type "88" terminal is disclosed in copending patent application Ser. No. 807,441 filed June 17, 1977. Alternatively, the worker may use the high force impact tool for the "66" type terminal on both configurations of terminals, and merely switch blades when terminating at one type terminal block or the other. However, when the worker must make thousands of such terminations at an installation, use of the high impact force type termination tool for both the "88" and "66" type terminations requires unnessary exertion and can become extremely tiring to the worker.

There is therefore a need for a single termination tool in which termination blades for both types of terminals may be used, which stores the unused blade for immediate access when needed, and which provides a selectable high or low impact force depending upon the type of terminal to which terminations are being made.

SUMMARY AND OBJECTS OF THE INVENTION

A terminal tool is disclosed providing an impact to a termination blade for connecting electrical conductors to electrical terminals, which includes a handle for manual engagement. A slide is mounted in one end of the handle, movable with respect to the handle, and yieldably urged toward an extended position from the end of the handle. The slide is configured to accept the termination blade. Within the handle is mounted a means for imparting an impact to the slide and therefore to the termination blade after the slide is forced inwardly from the extended position a predetermined distance. A pouch is provided in the other end of the handle which is also adapted to accept the termination blade and to releasably retain it within the pouch. Thus, when one terminal blade is mounted in the slide for use in terminating conductors at the electrical terminals, the other terminal blade is stored in retained position within the pouch. The tool further includes means mounted within the handle movable to one of two positions for setting the impact at either a high or low level for delivery to the slide.

In general, it is an object of the present invention to provide an impact type termination tool for use with more than one predominant type terminal currently in use.

Another object of the present invention is to provide an impact type termination tool wherein predetermined termination impact levels may be quickly selected.

It is another object of the present invention to provide an impact type termination tool which carries one termination blade in operating position and a second termination blade in stored position.

It is another object of the present invention to provide an impact type termination tool which provides the optimum impact level for conductor termination for more than one type of terminal.

Additional objects and features of the invention will appear from the following description in which the preferred embodiment has been set forth in detail in conjunction with the accompanying drawings.

DESCRIPTION OF THE PREFERRED EMBODIMENT

Figure 1:
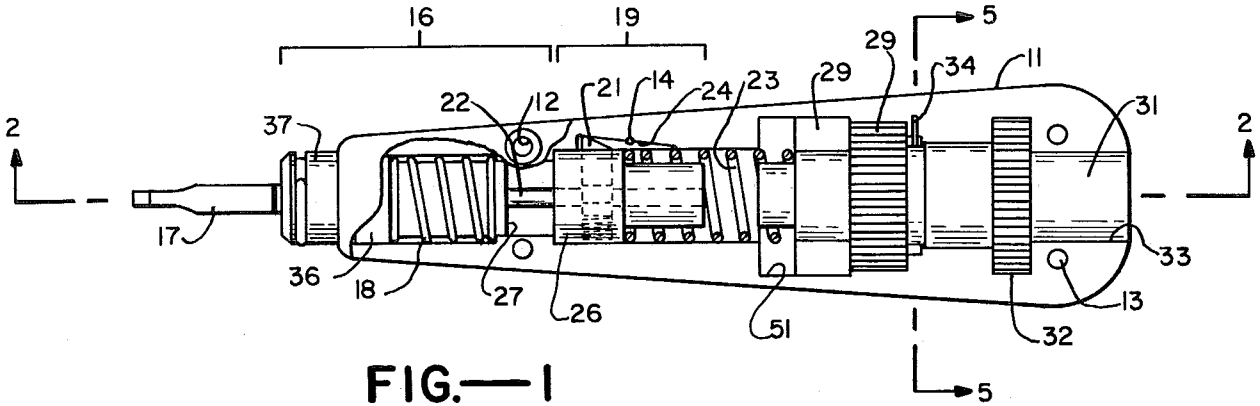
FIG. 1 is a cut-away plan view of the disclosed termination tool.

In FIG. 1 of the drawings the hand held impact tool disclosed herein is shown having a manually engageable handle 11 which may be fabricated from a plastic material, and which is conveniently constructed in the form of top and bottom handle halves. When the halves of handle 11 are positioned together they form an enclosure for the mechanism providing the tool functional characteristics. A pattern of 4 through holes 12 in each half of handle 11 is provided which accept fasteners, such as rivets or bolts and nuts 13 operating to hold the handle halves together. A positioning pin 14 is carried in one handle half and mates with an index hole carried in the other half of the handle 11 so that the tolerances on the positions of the patterns of holes 12 do not need to be too severe. Handle 11 contains a slide assembly 16 which is configured to accept a termination tool blade 17. Blade 17 is in turn configured to terminate electrical conductors at electrical terminals such as those found in telephone terminal installations. Slide assembly 16 may be of the type found in U.S. Pat. No. 3,708,852 or the above recited copending patent application Ser. No. 807,441 filed June 17, 1977, and blade 17 may be either the type shown in U.S. Pat. No. 3,883,316 or the above recited copending patent application Ser. No. 807,441 filed June 17, 1977. The type of blades 17 and slide assembly and the mechanism for retaining the blade in the slide are shown as the configuration disclosed in the last mentioned patent application for illustrative purposes throughout the remainder of this disclosure.

Slide assembly 16 extends from a front end of handle 11 and is movable relative thereto. A slide return spring 18 is mounted inside handle 11 urging slide assembly 16 toward the extended position. A force applied against the end of the extending slide assembly 16 causes the slide assembly to move inwardly of handle 11 against the extending force provided by slide return spring 18. A hammer assembly or impact assembly 19 is provided within handle 11, which may be of the type described in either U.S. Pat. Nos. 3,883,316 or 3,708,852. As described in the aforementioned patents, hammer assembly 19 has sear pin 21 urged into an extended position laterally therefrom by an internal spring (not shown). As slide assembly 16 is forced inwardly from the extended position, a projecting pin 22 carried thereon forces impact assembly 19 toward the rear end of handle 11 against an impact drive spring 23 bearing thereagainst. As hammer or impact assembly 19 is moved toward the rear of handle 11, a ramp 24 carried on the inside of handle 11 forces sear pin 21 laterally inward. When a hole (not shown) in sear pin 21 is aligned with projecting pin 22 through the lateral motion of sear pin 21, impact drive spring 23 drives impact assembly 19 toward the front end of handle 11. Hammer mass 26 in hammer assembly 19 impacts against an anvil surface 27 on slide assembly 16 thereby delivering an impact to slide assembly 16 and termination tool blade 17 mounted therein.

Impact drive spring 23 is seated against a seat member 28 which is movable axially within handle 11 between a position providing a short compressed length for impact drive spring 23 and a longer compressed length. As seen in FIG. 1, impact drive spring seat member 28 is in the position selecting the longer compressed length for impact drive spring 23. A rotatable knurled knob 29 is provided adjacent to seat member 28. Cam and cam follower surfaces, to be hereinafter described, are located between seat member 28 and rotatable knob 29, operating to position seat member 28 in one or the other of its two positions. A pouch member 31 is mounted within handle 11 disposed for rotational movement relative thereto. Pouch member 31 has a knurled knob 32 thereon, which is manually engageable so that rotation may be imparted to pouch member 31. Handle member 11 has an opening 33 in the rear end thereof, through which the end of pouch member 31 is accessible. A coil spring tab 34 is seen extending laterally from one end of pouch member 31. Tab 34 is held in place relative to handle 11 when the two halves thereof are fastened together.

Figure 2:
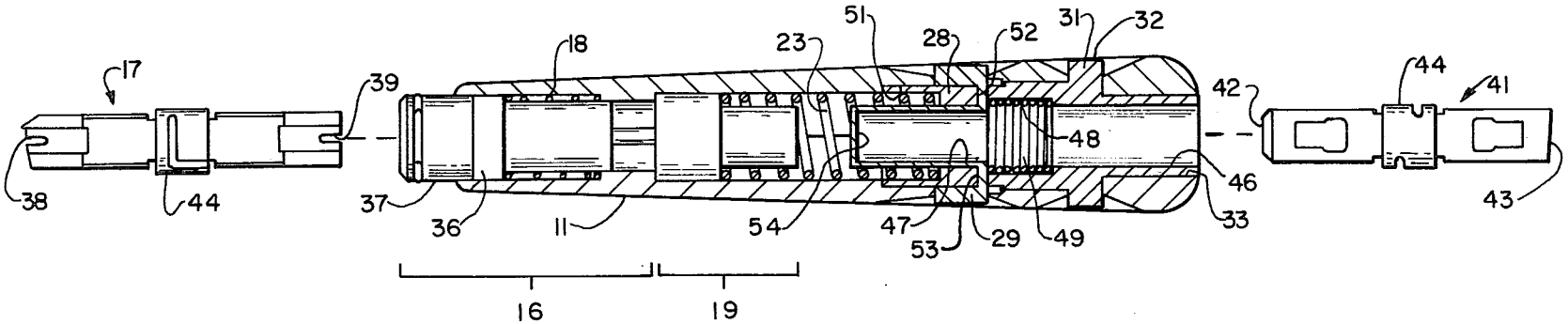
FIG. 2 is a sectional side elevation view of the termination tool and termination blades.

Turning now to FIG. 2. manually engageable handle 11 is shown enclosing slide assembly 16 and hammer or impact assembly 19. As shown, slide assembly 16 extends from the front end of handle 11 being retained therein against the force exerted by compressed slide return spring 18 by a square block portion 36 of slide assembly 16 adjacent to a cylindrical portion 37 extending from handle 11. Termination tool blade 17 is configured to be inserted, engaged, and retained within slide assembly 16 in the above recited the manner disclosed in copending application Ser. No. 807,441 filed June 17, 1977 for a "Termination Tool Blade and Slide Apparatus". Note that termination tool blade 17 is a dual ended blade having a cutting and seating edge 38 and a seating edge 39. An additional termination tool blade 41 is shown positioned proximate to the rear end of manually engageable handle 11, also having a cutting and seating edge 42 and a seating edge 43. Both termination tool blades 17 and 41 have a cylindrical center section 44 which is accepted in slide assembly 16 as well as in a bore 46 within pouch member 31. Bore 46 is in communication with opening 33, whereby either termination tool blade 17 or 41 may be inserted into bore 46. Rotatable knurled knot 29 has a blind bore 47 therein in communication with bore 46. Blind bore 47 is of a size to accept either end of both terminal tool blades 17 and 41. An oversized segment 48 of bore 46 has mounted therein a tightly wound coil spring 49 attached to coil spring tab 34. The inside diameter of coil spring 49 is slightly smaller than the diameter of cylindrical center section 44 on terminal tool blades 17 and 41. The end of coil spring 49 opposite tab 34 is affixed to pouch member 31 for rotation therewith. Consequently, when pouch member 31 is rotated in a direction contrary to the spiral wound direction of coil spring 49, the inside diameter of coil spring 49 enlarges within oversized segment 48 of bore 46. This direction of rotation will be referred to as the release direction of rotation. When knurled knob 32 is rotated in the release direction, either termination tool blade 17 or 41 may be inserted into bore 46 with one end extending into blind bore 47, and cylindrical center section lying within tightly wound coil spring 49. When knurled knob 32 is disengaged, coil spring 49 drives pouch member 31 rotationally away from the release position, and the inside diameter of coil spring 49 diminishes and engages cylindrical center section 44 to retain termination tool blade 17 or 41 within pouch member 31.

Seat member 28 is disposed for rectilinear motion within a chamber 51 in handle 11, and is prevented from rotating therein. Seat member 28 has a cam follower surface 52 thereon which is in contact with a cam surface 53 on rotatable knurled knob 29. Cam follower surface 52 is held in engagement with cam surface 53 by the force exerted against seat member 28 by compressed impact drive spring 23. Seat member 28 is held by the force of impact drive spring 23 in a position to allow drive spring 23 to assume its longest compressed length. Rotation of rotatable knurled knob 29 through an angle of less than 180°, in this embodiment, forces seat member 28 in a rectilinear direction toward the front end of handle 11 within chamber 51 thereby compressing drive spring 23 to its shortest compressed length. Cam follower surface 52 has a detent within which cam surface 53 fits when the shortest compressed length of impact drive spring 23 is reached. Consequently, there is no ramp effect returning seat member to the longest compressed length position, and the additional compression in impact drive spring 23 is maintained until manually reset to the alternate longest compressed length position. Alternate means for positioning seat member 28 in one of the two positions within chamber 51 are envisioned, including an external manually operated two position snap lever (not shown), or a collapsable crank member (not shown) which is unfolded from the surface of the handle 11 and actuated to select either the short or long compressed length position for drive spring 23.

It should be noted that blind bore 47 prevents dust and dirt particles from entering into the interior of handle 11 which is occupied by slide assembly 16 and hammer assembly 19. It is necessary that the "well" formed by opening 33, bore 46 and blind bore 47 be readily accessible to an operator of the impact termination tool for ready insertion and removal of the spare blade stored within pouch member 31. The configuration disclosed herein allows such ready accessibility, while isolating the more delicate moving parts within the interior of handle 11 from ambient dirt and dust by providing the end 54 on bore 47. It should also be noted that the peripheries of rotatable knurled knob 29 and knurled knob 32 for selecting impact force level and for insertion and release of a stored terminal tool blade respectively are both within the outline dimensions of manually engageable handle 11. Thus, the probability of an accidental selection of impact force selection or termination tool blade release by inadvertently brushing against an outside object, is reduced. Two stable selected positions for seat member 28 are provided within chamber 51 providing for shortened compressed lengths in drive spring 23 and consequent high impact forces, and a longer compressed length for drive spring 23 providing a lower impact force.

Figure 3:
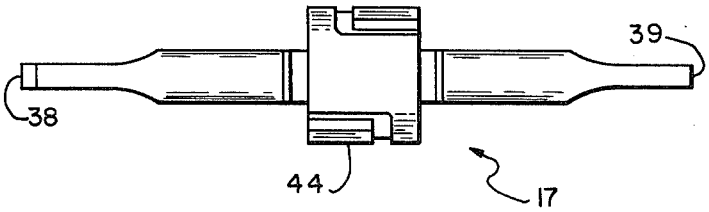
FIG. 3 is a plan view of one of the termination blades of FIG. 2.
Figure 4:
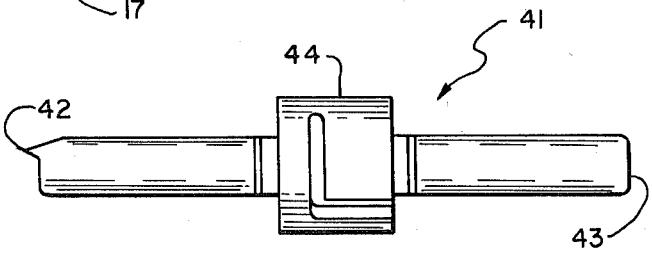
FIG. 4 is a plan view of the other of the termination blades of FIG. 2.

FIG. 3 shows the termination tool blade 17 disclosed in the above recited copending patent application Ser. No. 807,441 filed June 17, 1977, having cylindrical center section 44 thereon and containing the "L" shaped grooves disclosed therein. FIG. 4 shows the cutting and seating edges 42 and 43 for termination tool blade 41 disclosed in U.S. Pat. No. 3,883,316, modified by addition of cylindrical center section 44 thereto. "L" shaped grooves are also included on termination tool blade 41. An "88" type terminal (Western Electric Company designation) requires the configuration of termination tool blade 17. The "88" type terminal accepts a smaller conducting wire. A "66" type terminal (Western Electric Company designation) requires a terminal tool blade having the configuration of blade 41 of FIG. 4. A larger diameter conducting wire is terminated at the "66" type terminals. A higher impact force is necessary to seat and/or sever conductors at the "66" type terminals therefor. When termination work is to be done at a "66" type terminal, termination tool blade 17 is removed from slide assembly 16 and termination tool blade 41 is removed from pouch member 31 by rotating knurled knob 32 to the release position. Termination tool blade 17 is inserted into bore 46 in pouch member 31 while knurled knob 32 is rotated to the release position to allow the diameter of cylindrical center section 44 to fall within the tightly wound coil spring 49. Releasing the rotational force on knurled knob 32 causes tightly wound coil spring 49 to capture termination tool blade 17 within pouch member 31. Termination tool blade 41 is inserted into slide assembly 16, and rotatable knurled knob 29 is turned to move seat member 28 to compress impact drive spring 23 to its shortest compressed length. Terminations at a "66" type terminal block are thereafter undertaken having the proper blade and force in use for such terminations and having the spare termination tool blade 17 stored in an out of the way position. Terminations performed on an "88" type terminal block will require removal of termination tool blade 17 from pouch member 31 by rotating knurled knob 32 to the release position, insertion of blade 17 into slide assembly 16, and placement of blade 41 in storage in pouch assembly 31 as described above for termination tool blade 41. Knurled knob 29 is thereafter rotated to allow impact drive spring 23 to assume its longest compressed length. Terminations of the smaller wire with lower impact force on the "88" type terminal may now be undertaken.

Figure 5:
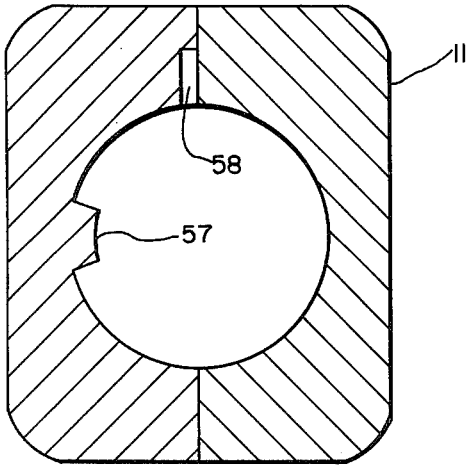
FIG. 5 is a sectional view along the line 5—5 of FIG. 1.

FIG. 5 is a sectional view showing a stop member 57 on the interior of handle 11. Stop member 57 is configured to contact a corresponding stop member on rotatable knurled knob 29 to be hereinafter described. A detent 58 is shown formed in one half of handle 11. Detent 58 is configured to receive coil spring tab 34, thereby affixing one end of tightly wound coil spring 49 to handle 11.

Figure 6:
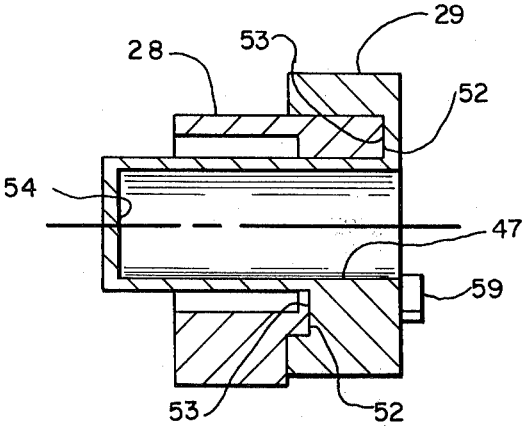
FIG. 6 is a cut-away view of a cam and cam follower subassembly.

While other means of setting the compressed lengths of impact drive spring 23 at a length to provide the desired impact force from hammer assembly 19 are envisioned, the combination of seat member 28 and rotatable knurled knob 29 as seen in FIG. 6 is found to be a preferred embodiment. FIG. 6 demonstrates the fashion in which seat member 28 and rotatable knurled knob 29 cooperate to obtain the rectilinear motion of seat member 28 within chamber 51 in handle 11. The cam follower surface 52 on seat member 28 is repeated every 180° to provide a resulting force on seat member 28 which is parallel to the longitudinal axis of handle 11. A stop member 59 is formed on one edge of knurled knob 29. Stop member 59 is configured to engage stop member 57 in handle 11. Stops 57 and 59 prevent inadvertent rotation of knurled knob 29 through more than 180°, which would force cam surface 53 past the detent in cam follower surface 52 and allow drive spring 23 to abruptly drive seat member 28 back to the rear end of chamber 51. Seat member 28 may be seen to have a rectangular cross section, which prevents rotation of seat member 28 within chamber 51. The closed end for blind bore 47 provided by end wall 54 may be seen clearly in FIG. 6.

Figure 7:
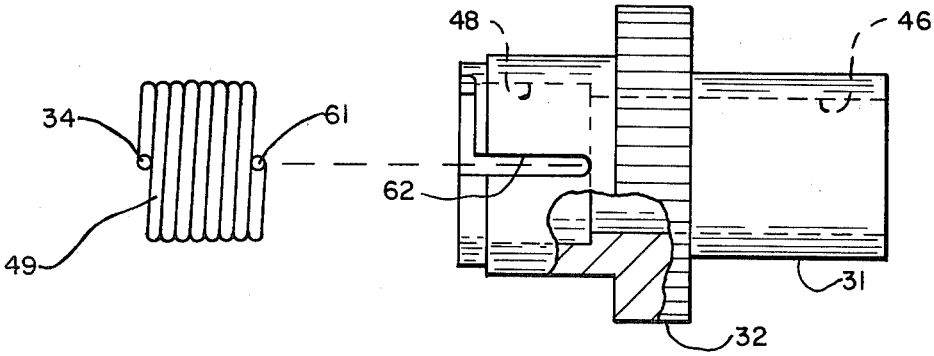
FIG. 7 is an exploded view of the termination tool storage pouch subassembly.

The manner in which tightly wound coil spring 49 is assembled within oversized diameter 48 in pouch member 31 is shown in FIG. 7. Coil spring tab 34 is shown on one end of coil spring 48 and a shorter tab 61 is shown on the opposite end. An elongate slot 62 is formed in one side of and extending through the wall of pouch member 31 which surrounds oversized diameter 48. Coil spring 49 is placed within oversized diameter 48 with short tab 61 retained at the closed end of elongate slot 62. When knurled knob 32 is rotated toward the release position after assembly in handle 11, it may be seen that the end of coil spring 49 at which short tab 61 is formed is rotated relative to the end of coil spring 49 at which tab 34 is formed. Rotation in the "release" direction, in a direction contra to the spiral winding direction of coil spring 49, will tend to "unwind" coil spring 49 and thereby temporarily increase the inside diameter thereof. As explained hereinabove, the outside of cylindrical center section 44 on the termination tool blades 17 and 41 clears the inside diameter of coil spring 49 when knurled knob 32 is rotated toward the "release" position, and is engaged by the inside diameter when coil spring 49 is allowed to assume a relaxed position. In this fashion the spare termination tool blade 17 or 41 is retained in stored position within pouch member 31 while not in use.

A termination tool has been disclosed which provides mounting and storage for two dual ended termination tool blades. The two termination tool blades are utilized on two different configurations of terminals. The disclosed termination tool also provides for one of two impact levels required for terminating electrical conductors at one or the other of the two termination configurations.

What is claimed is:

1. A hand held impact tool for use in terminating electrical conductors at a terminal block, comprising an elongate handle, a slide assembly mounted in said handle yieldably urged toward a position extending from one end thereof, a hammer assembly mounted in said handle operating to deliver a hammer blow to said slide assembly, a drive spring seat member mounted in said handle, a hammer drive spring extending between said hammer assembly and said drive spring seat member urging said hammer assembly toward said slide assembly, a cam follower surface on said seat member, a cam bearing against said cam follower surface and mounted in said handle being movable relative thereto, movement of said cam operating to alter the compressed length of said hammer drive spring, whereby said hammer blow is greater when the compressed length is lesser, a pouch assembly in the other end of said handle, said slide and pouch assemblies being configured to accept termination tool blades including means for engaging the electrical conductors, each of said slide and pouch being independent of the other whereby to store one termination blade in said pouch assembly while, at the same time, another termination blade is mounted in said slide assembly for use in terminating the electrical conductors, and means in said pouch assembly for releasably retaining either of said termination blades therein, said pouch assembly comprising a storage cylinder movable rotationally relative to said handle and having a bore therethrough accepting the termination tool blade, said means for releasably retaining a termination blade comprising a coil spring mounted in said bore having one end thereof movable with said storage cylinder and having a diameter smaller than said storage cylinder bore and operating to engage the termination tool blade, whereby torquing of said storage cylinder in a sense contra to the spring coil direction expands said inside diameter and releases the termination tool blade from said bore.

2. An impact termination tool utilizing a termination blade for connecting electrical conductors to electrical terminals, comprising a handle, a slide mounted in one end of said handle movable with respect thereto and yieldably urged toward an extended position therefrom, said slide including means for accepting the termination blade, means mounted in said handle for imparting an impact to said slide when said slide is forced inwardly from said extended position a predetermined distance, a pouch in the other end of said handle and including means for accepting the termination blade and releasably retaining it therein, so that when one terminal blade is mounted in said slide operating to terminate conductors at the electrical terminals, another terminal blade is stored and retained within said pouch, said handle having an opening in the other end, said pouch comprising a cylinder movable rotationally in said handle and having a bore therein in communication with said opening, and said accepting and retaining means including a coil spring in said bore having one end of the coil movable with said cylinder and having an inside diameter smaller than said bore which is adapted to engage the termination tool, whereby rotation of said cylinder in a direction contra to the direction of spiral of said coil spring expands said inside diameter allowing insertion and removal of the termination blade therefrom.

3. An impact termination tool as in claim 2 together with means mounted in said handle movable to one of two positions for setting said impact at a high or a low level, whereby conductor connections with one termination blade requiring low impact level are made when the means for setting is at one of the two positions with reduced operator effort, and connections with the other termination blade requiring high impact level are accomplished with the means for setting at the other of the two positions.

* * * * *